US008944044B2

(12) United States Patent
Buck et al.

(10) Patent No.: US 8,944,044 B2
(45) Date of Patent: Feb. 3, 2015

(54) ONE-PIECE FASTENING ELEMENT FOR A COOKING HOB AND A COOKING HOB WITH ONE-PIECE FASTENING ELEMENTS

(75) Inventors: Bernd Buck, Windelsbach (DE); Bjorn Leyh, Blaufelden (DE); Alwin Neukamm, Wilhermsdorf (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 832 days.

(21) Appl. No.: 12/997,936

(22) PCT Filed: Jun. 25, 2009

(86) PCT No.: PCT/EP2009/004587

§ 371 (c)(1), (2), (4) Date: Dec. 14, 2010

(87) PCT Pub. No.: WO2010/003554

PCT Pub. Date: Jan. 14, 2010

(65) Prior Publication Data

US 2011/0100350 A1 May 5, 2011

(30) Foreign Application Priority Data

Jul. 9, 2008 (EP) ..... 08012379

(51) Int. Cl.
*F24C 15/10* (2006.01)

(52) U.S. Cl.
CPC ..... *F24C 15/108* (2013.01)
USPC ..... 126/214 A; 403/329; 248/27.3; 248/500

(58) Field of Classification Search
USPC ..... 403/329; 126/241 A, 214 A; 248/500, 248/27.3
See application file for complete search history.

(56) References Cited

U.S. PATENT DOCUMENTS 2,328,757 A * 9/1943 Tinnerman ..... 49/463
3,368,780 A * 2/1968 Buttriss ..... 248/27.3
3,585,333 A * 6/1971 Valle et al. ..... 200/295

(Continued)

FOREIGN PATENT DOCUMENTS

DE 2064248 * 4/1972
DE 3440868 6/1985

(Continued)

OTHER PUBLICATIONS

International Search Report for PCT/EP2009/004587, dated Sep. 23, 2009, 2 pages.

*Primary Examiner* — Kenneth Rinehart
*Assistant Examiner* — Gajanan M Prabhu
(74) *Attorney, Agent, or Firm* — Pearne & Gordon LLP

(57) ABSTRACT

The present invention relates to a one-piece fastening element (10) with a cooking hob (24). The fastening element (10) comprises an upper portion (12) being permanently connectable to an upper part (26) of the cooking hob (24) and a lower portion (14) being detachably connectable to a lower part (28) of the cooking hob (24), so that the upper part (26) and the lower part (28) form the cooking hob (10). The lower portion (14) of the fastening element (10) comprises at least one lug element (18) engageable with a recess (30) in the lower part (28) of the cooking hob (24) and at least one spring element (22) for clamping the cooking hob (24) within a cutout (38) enclosing circumferentially said cooking hob (24). Further, the present invention relates to a cooking hob with such one-piece fastening elements.

16 Claims, 4 Drawing Sheets

(56) References Cited

U.S. PATENT DOCUMENTS

Figure 1:
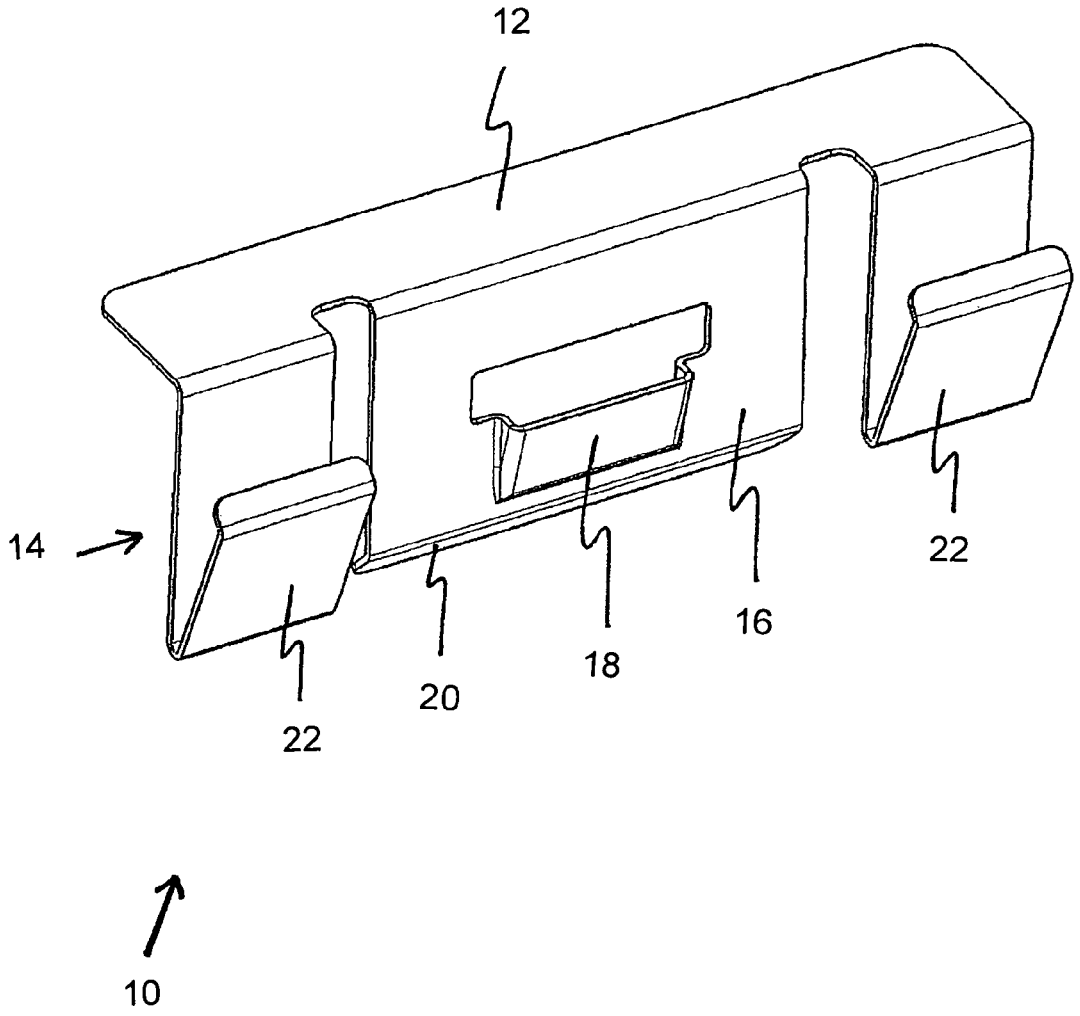

| | | | | | |
|---|---|---|---|---|---|
| 3,613,177 | A | * | 10/1971 | Davis | 4/643 |
| 3,680,152 | A | * | 8/1972 | Farrell | 4/633 |
| 3,971,361 | A | | 7/1976 | Hurko | |
| 4,237,368 | A | | 12/1980 | Welch | |
| 5,513,909 | A | * | 5/1996 | Teich | 312/351.6 |
| 5,653,550 | A | * | 8/1997 | Mutz et al. | 403/329 |
| 5,893,359 | A | * | 4/1999 | Schultheis et al. | 126/214 A |
| 6,207,933 | B1 | * | 3/2001 | Stedron et al. | 219/452.11 |
| 6,330,991 | B1 | * | 12/2001 | Boe | 248/200 |
| D543,447 | S | * | 5/2007 | Allsopp | D8/394 |
| 7,523,511 | B2 | * | 4/2009 | Marr et al. | 4/633 |
| 2005/0235982 | A1 | * | 10/2005 | Gama et al. | 126/39 BA |
| 2007/0169770 | A1 | * | 7/2007 | Kuwamura | 126/211 |

FOREIGN PATENT DOCUMENTS

| | | | | |
|---|---|---|---|---|
| DE | 3441281 | | | 5/1986 |
| DE | 8624136 | | | 11/1986 |
| DE | 4040093 | | | 8/1991 |
| DE | 4202807 | | | 3/1993 |
| DE | 19835140 | | | 2/2000 |
| EP | 0234373 | | | 9/1987 |
| EP | 1515092 | | | 3/2005 |
| ES | 1067491 | U | * | 5/2008 |
| GB | 2092739 | | | 8/1982 |
| WO | 2007028735 | | | 3/2007 |

* cited by examiner

ONE-PIECE FASTENING ELEMENT FOR A COOKING HOB AND A COOKING HOB WITH ONE-PIECE FASTENING ELEMENTS

The present invention relates to a one-piece fastening element for a cooking hob according to claim 1. Further, the present invention relates to a cooking hob with one-piece fastening elements according to claim 10.

In a cabinet of a kitchen a cooking hob has to be fastened within a cutout, which supports and/or surrounds said cooking hob. The cutout is arranged directly in a worktop of the cabinet in the kitchen. Typically, the cooking hob is fastened within the cutout by screw fastenings.

DE 198 35 140 A1 discloses a cooking hob provided for the cutout within the worktop of a cabinet. The device for fastening the cooking hob in the cutout comprises multiple different elements. Thus, the installation of the cooking is very complex.

It is an object of the present invention to provide a fastening element and a cooking hob with according fastening elements, which allow an easy installation of the cooking hob in the cutout of the worktop.

The object of the present invention is achieved by the cooking hob according to claim 1.

The present invention relates to a one-piece fastening element for a cooking hob, wherein:

- the fastening element comprises an upper portion being permanently connectable to an upper part of the cooking hob,
- the fastening element comprises a lower portion being detachably connectable to a lower part of the cooking hob,
- so that the upper part and the lower part form the cooking hob,
- the lower portion of the fastening element comprises at least one lug element engageable with a recess in the lower part of the cooking hob, and
- the lower portion of the fastening element comprises at least one spring element for clamping the cooking hob within a cutout enclosing circumferentially said cooking hob.

The main idea of the present invention is the fastening element with the lug element and the spring element. The lug element allows the joint of the upper and lower part of the cooking hob by a snap-in mechanism. The spring element supports the mounting of the cooking hob within the cutout of a worktop. The inventive fastening element requires no special means at the upper and lower part of the cooking hob. Only the recess in the sidewall of the lower part is necessary. However, if a lower part without recesses is used, then it is a simple procedure to cut said recesses into the sidewall of the lower part. Thus, a standard upper part and a standard lower part can be jointed to a cooking hob by the inventive fastening elements.

The upper portion of the fastening element is permanently connected or connectable to the upper part. The lower part is detachably connected to the fastening element. The resulting cooking hob is then connectable to the cutout by the at least one spring element of the same fastening element. At least two fastening elements at opposite side walls of the cooking hob are sufficient for a stable installation of the cooking hob within the cutout. The lug element and the associated recess allow a stable connection. Preferably, the recess is marginally bigger than the lug element.

With the inventive fastening element, the lower part of the cooking hob may be released from the upper part of the cooking hob, when said upper part is still fastened within the cutout of the worktop.

According to the preferred embodiment of the present invention the upper portion comprises at least one sheet element extending along a horizontal plane and the lower part comprises sheet elements extending along a vertical plane in a mounted state of said fastening element at the cooking hob. This allows a stable joint between the upper and lower part.

Further, the lug element is formed at a vertical sheet element and extends along a vertical direction, in particular in a radial vertical direction, in the mounted state. Thus, the lug element may be snapped-in and snapped-out by a horizontal movement of the vertical sheet.

Preferably, the vertical sheet with the lug element comprises a buckled appendix acting as a grip in order to release the lug element from the recess. Thus, the connection between the upper and lower part of the cooking hob may be easily released.

Further, at least two sheet elements, in particular three sheet elements, may be displaced in such a way that a sidewall of the lower part is engageable between said sheet elements. This allows a stable joint between the fastening element and the lower part. Preferably, the sidewall is engageable in such a way that the large-scale sides of said sidewall rest partially at large-scale sides of the sheet elements.

For example, the spring element is a leaf-spring and has a U-shaped form. This is a simple and efficient construction of the spring element.

Preferably, the fastening element is made of a metal sheet, in particular of steel, stainless steel or aluminium. The fastening element is easily producible and has a stable construction.

Additionally, the upper portion of the fastening element may be glueable at the upper part of the cooking hob, in particular at a glass-ceramic panel. Since the lower part of the cooking hob is usually made of another material, e.g. steel, the fastening element allows an easy and stable connection between the glass-ceramic panel and the lower part of the cooking hob. There is no shearing force at the adhesive area.

At last, the substantial parts of the upper portion and the lower portion form a right angle. The preferred embodiment of the inventive fastening element has substantially the form of an L-profile. This form is adapted to the upper and lower part of the cooking hob. The horizontal upper portion is adapted to the flat upper part. The vertical lower portion is adapted to the side walls of the lower part.

The object of the present invention is further achieved by the cooking hob with at least two one-piece fastening elements according to claim 10.

The present invention relates further to a cooking hob with at least two one-piece fastening elements arranged or mountable at outer portions of the cooking hob, wherein:

- the fastening element comprises an upper portion being permanently connected or connectable to an upper part of the cooking hob,
- the fastening element comprises a lower portion being detachably connected or connectable to a lower part of the cooking hob,
- so that the upper part and the lower part form the cooking hob,
- the lower part of the cooking hob comprises at least two recesses in sidewalls of said lower part,
- the lower portion of the fastening element comprises at least one lug element engaged or engageable with the recess, the lower portion of the fastening element comprises at least one spring element at a side wall of the cooking hob in order to clamp the cooking hob within a cutout enclosing circumferentially the cooking hob, and at least two fastening elements are arranged at opposite side walls of the cooking hob.

The main idea of the inventive cooking hob is the one-piece fastening element, which is provided to connect the upper part to the lower part of the cooking hob on the one hand and to adjust the resulting cooking hob within the cutout on the other hand. The lug element allows the joint of the upper and lower part of the cooking hob by a snap-in mechanism. The spring element supports the mounting of the cooking hob within the cutout of a worktop. The fastening element of the inventive cooking hob requires no special means at the upper and lower part of the cooking hob. Only the recess in the sidewall of the lower part is necessary. The geometric form of the fastening element allows these two different connections with one single fastening element. The upper part of the cooking hob is permanently connected to the fastening element. The lower part of the cooking hob is detachably connected to the fastening element. The resulting cooking hob is then connectable to the cutout by the same fastening element.

In particular, the cooking hob comprises at least two one-piece fastening elements as described above.

Preferably, the upper part of the cooking hob is a glass-ceramic panel and the lower part of the cooking hob is a casing covered by said glass-ceramic panel in a mounted state.

The casing may be provided for an electric or electronic circuitry arranged at the bottom side of the upper part of the cooking hob. This is a contribution to a compact construction of the cooking hob. Especially, the casing comprises an open top side covered by the bottom side of the upper part of the cooking hob.

For example, the casing is made of at least one metal sheet, in particular of steel, stainless steel or aluminium. Alternatively, the casing is made of plastics. This allows a production with low costs. The casing can be adapted to the form of the electric or electronic circuitry and other components.

According to the preferred embodiment of the present invention the lower part comprises an opening or a slot associated with the recess in order to allow a tool to penetrate through said opening or slot, respectively, in order to release the lug element from the recess. Preferably, the opening or the slot is arranged in the outermost position of the bottom and under the corresponding recess.

The novel and inventive features believed to be the characteristic of the present invention are set forth in the appended claims.

Figure 2:
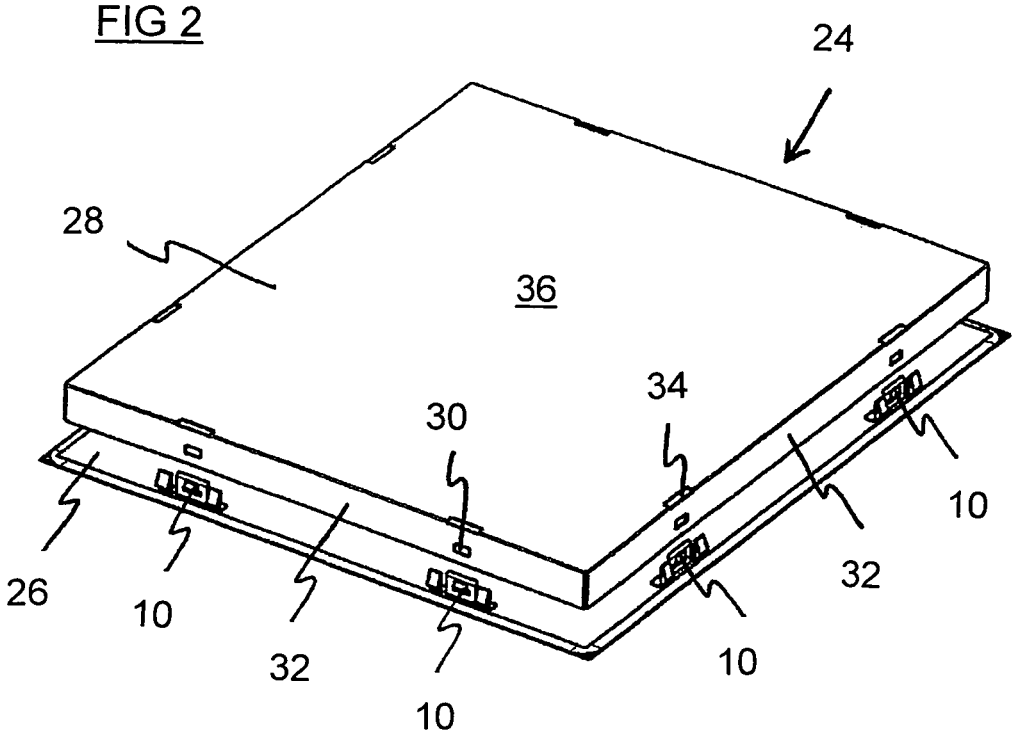
Figure 3:
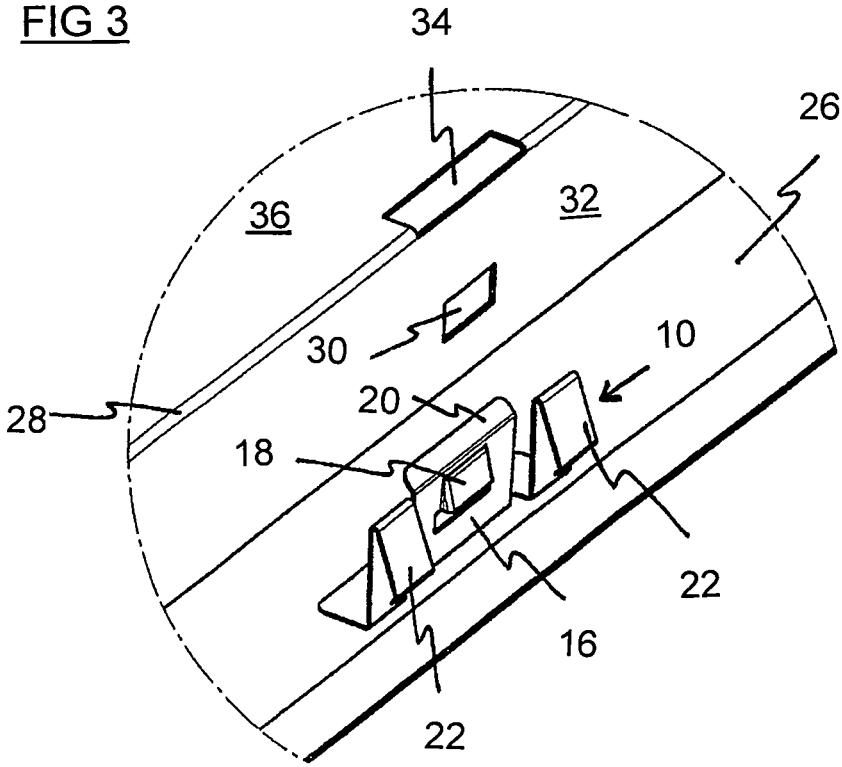
Figure 4:
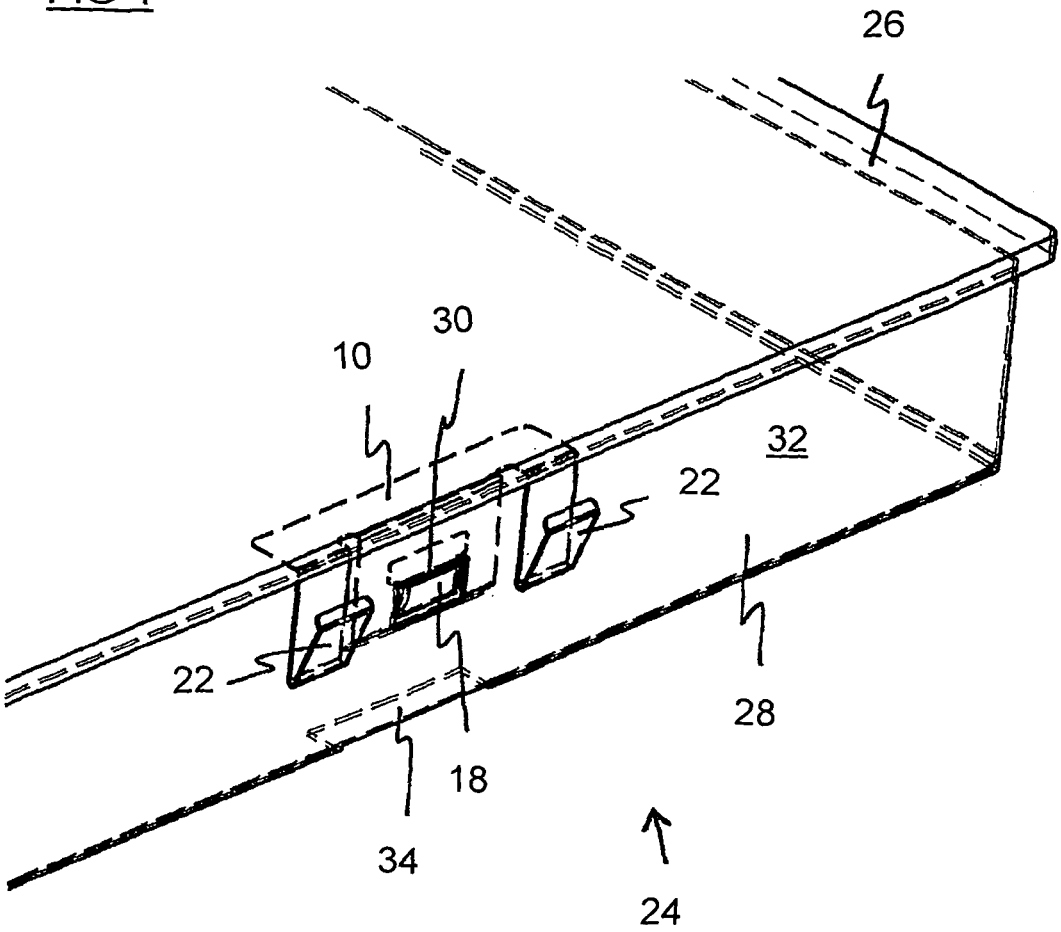
Figure 5:
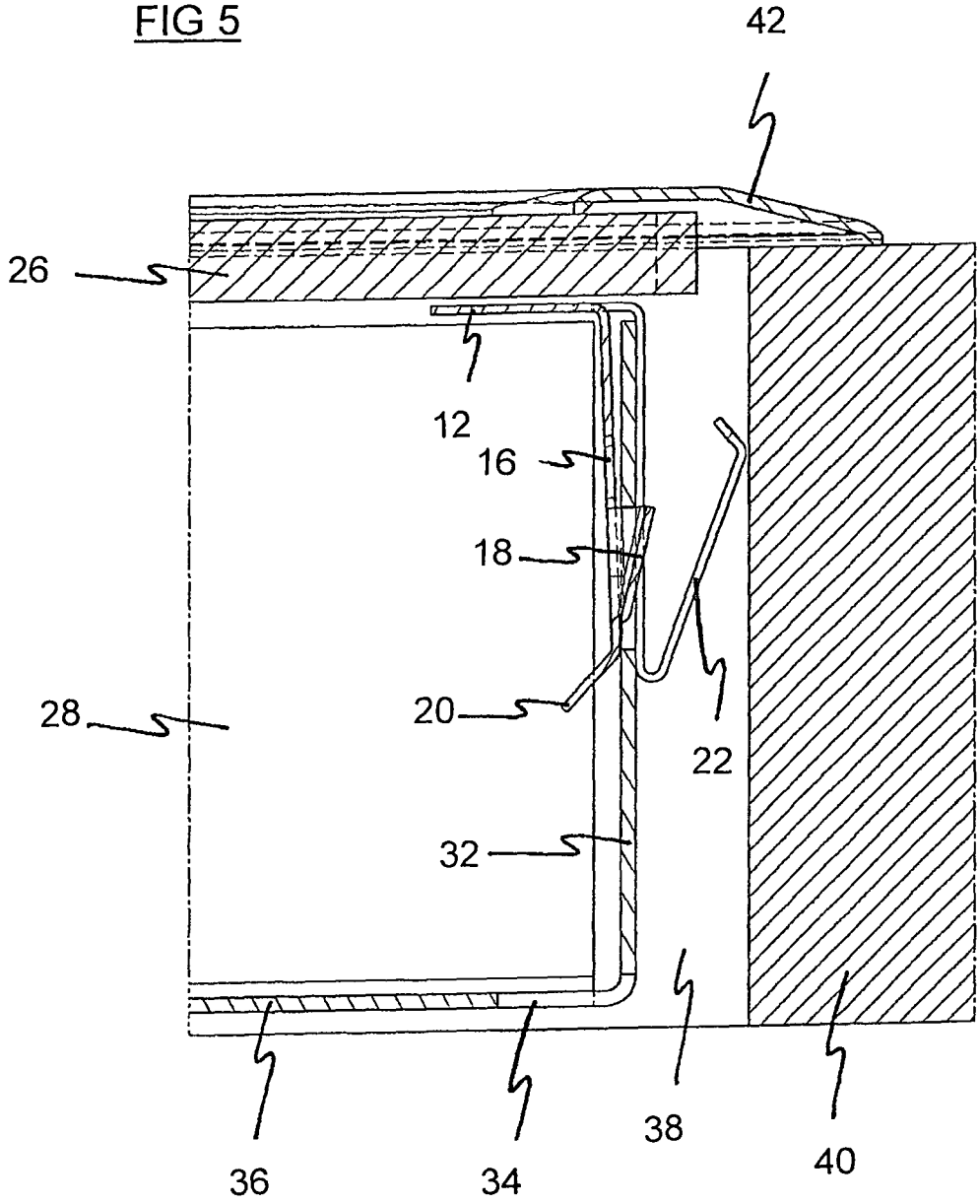

The invention will be described in further detail with reference to the drawing, in which FIG. 1 illustrates a schematic diagram of a perspective view of a fastening element for a cooking hob according to a preferred embodiment of the present invention, FIG. 2 illustrates a schematic diagram of an exploded perspective view at the bottom side of the cooking hob with the fastening element according to the preferred embodiment of the present invention, FIG. 3 illustrates a detailed schematic diagram of the exploded view of the cooking hob with the fastening element according to FIG. 2, FIG. 4 illustrates a schematic diagram of a perspective view of the cooking hob with the fastening element according to the preferred embodiment of the present invention in a mounted state, and FIG. 5 illustrates a schematic diagram of a sectional side view of the fastening element arranged at the cooking hob within a cutout of a worktop according to the preferred embodiment of the present invention.

FIG. 1 illustrates a schematic diagram of a perspective view of a fastening element 10 for a cooking hob 24 according to a preferred embodiment of the present invention. The fastening element 10 is a one-piece element. For example, the fastening element 10 may be produced by folding a metal sheet. Preferably, said metal sheet is made of steel, stainless steel or aluminium. Alternatively, the fastening element 10 may be made of a synthetic material, e.g. plastics.

The fastening element 10 comprises an upper portion 12 and a lower portion 14. Substantially, the upper portion 12 and the lower portion 14 of the fastening element 10 extend perpendicularly to each other. The main part of the fastening element 10 is similar to an L-section. In the mounted state, the plane of the upper portion 12 extends in a horizontal direction.

The upper portion 12 of the fastening element 10 is formed as a plane sheet. The upper side of the upper portion 12 is provided to be permanently fixed at a bottom side of an upper part 26 of a cooking hob 24. Preferably, the upper side of the upper portion 12 is provided to be glued at the bottom side of the upper part 26 of the cooking hob 24. In particular, said upper part 26 is a glass-ceramic panel.

The lower portion 14 of the fastening element 10 comprises a supporting element 16 and two spring elements 22. The supporting element 16 is arranged between the spring elements 22. In the mounted state, the supporting element 16 and the spring elements 22 extends in a vertical direction. The supporting element 16 and the spring elements 22 are displaced in such a way, that a sheet may be pushed between the supporting element 16 on the one side and the spring elements 22 on the other side, wherein large-scale sides of the supporting element 16 and the spring elements 22 rest against large-scale sides of said sheet. The lower portion 14 of the fastening element 10 is provided to be connected to a sidewall 32 of a lower part 28 of the cooking hob 24.

The supporting element 16 comprises a lug element 18 in its central portion. The lug element 18 is provided to engage with a recess 30 in the sidewall 32 of the lower part 28. The lug element 18 snaps in, if the fastening element 10 is moved downwards in relation to the sidewall 32. The lug element 18 extends into an outer direction of the cooking hob 24.

Further, the supporting element 16 comprises a buckled appendix 20 at its lower end portion. The appendix 20 extends downwardly and into the opposite direction of the lug element 18. The appendix 20 is provided as a point of action in order to curve the supporting element 16 into said inner direction, so that the lug element 18 can be released from the recess 30.

The spring elements 22 have a U-shaped form and are elastic. The open ends of said spring elements 22 are provided to extend into the outer direction of the cooking hob 24. The elastic properties of the spring elements 26 act into a radial direction. The spring elements 22 are provided to clamp the cooking hob 24 within a cutout 38 of a worktop 40.

FIG. 2 illustrates a schematic diagram of an exploded perspective view at the bottom side of the cooking hob 24. In FIG. 2 the bottom side of the cooking hob 24 is above. Eight fastening elements 10 according to the preferred embodiment are fixed on a bottom side of the upper part 26 of the cooking hob 24. All fastening elements 10 are arranged in the outer portion of the upper part 26. In this example, the upper part 26 of the cooking hob 24 is a glass-ceramic panel. Preferably, the upper sides of the upper portions 12 are glued at the bottom side of the glass-ceramic panel.

In FIG. 2 the lower part 28 of the cooking hob 24 is not yet mounted onto the upper part 26. The lower part 28 of the cooking hob 24 comprises a bottom 36 and four sidewalls 32. Thus, the lower part 28 of the cooking hob 24 is a casing with an open top side. The upper part 26 of the cooking hob is provided to cover said open top side.

Each sidewall 32 comprises two recesses 30. In this example the recess 30 has a rectangular form. The recess 30 is associate with the corresponding lug element 18 in the supporting element 16 of the fastening element 10. The recess 30 is marginally bigger than the lug element 18. Each recess 30 is associated with a slot 34 in the bottom 36 of the lower part 28. The slot 34 is arranged below the associated recess 30 and besides the edge of the bottom 36.

The lower part 28 of the cooking hob 24 may be provided for an electric or electronic circuitry. In this example the lower part 28 of the cooking hob 24 is made of a metal sheet.

FIG. 3 illustrates a detailed schematic diagram of the exploded view according to FIG. 2. FIG. 3 shows the environment of one of the fastening elements 10 in FIG. 2. The fastening element 10 is glued onto the bottom side of the upper part 26 of the cooking hob 24. The lug element 18 and the recess 30 are arranged in such a way, that the lug element 18 engages in the recess 30, if the upper part 26 and the lower part 28 are put together. When the upper part 26 is set from above onto the lower part 28, then the lug element 18 is latched into the recess 30. The upper part 26 and the lower part 28 of the cooking hob 24 are jointed by at least two lug elements 18 and two associated recesses 30.

The slot 34 allows that the lug element 18 can be released from the recess 30, wherein a tool acts on the appendix 20 in order to curve the supporting element 16 away from the sidewall 32. The appendix 20 of the supporting element 16 is provided to pull the lug element 18 out of the recess 30. Thus, the upper part 26 of the cooking hob 24 may be easily removed again from the lower part 28 of the cooking hob 10.

FIG. 4 illustrates a schematic diagram of a perspective view of the cooking hob 24 with the fastening element 10 in the mounted state. In FIG. 4 the upper part 26 and the lower part 28 of the cooking hob 24 are jointed together by the fastening element 10 according to the preferred embodiment of the present invention. In the mounted state, the upper part 26 covers the lower part 28 of the cooking hob 24.

The upper portion 12 of the fastening element 10 is glued onto the bottom side of the upper part 26 of the cooking hob 24. The lug element 18 in the supporting element 16 of the lower portion 14 is engaged with the recess 30 in the sidewall 32 of the lower part 28. By inserting a tool into the slot 34 against the appendix 20 of the supporting element 16, the lug element 18 can be released form the recess 30.

The fastening element 10 according to the present invention has two functions. On the one hand, the fastening element 10 joins the upper part 26 with the lower part 28. On the other hand, the fastening element 10 clamps the resulting cooking 24 within the cutout 30 of the worktop 40.

FIG. 5 illustrates a schematic diagram of a sectional side view of the fastening element 10 arranged at the cooking hob 24 within the cutout 38 of the worktop 40 according to the preferred embodiment of the present invention. In this example the upper part 26 is a glass-ceramic panel.

The upper part 26 of the cooking hob 24 is arranged above the lower part 28 of said cooking hob 24. The upper portion 12 of the fastening element 10 is glued at the bottom side of the upper part 26. The upper part 26 and the lower part 28 of the cooking hob 24 are jointed by the engagement of the lug element 18 in the recess 30 of the sidewall 32. The cooking hob 24 comprises at least two fastening elements 10 of the invention. At least two of said fastening elements 10 are arranged at opposite sides of the cooking hob 24.

The cooking hob 24 is clamped by the spring elements 22 within the cutout 38 of the worktop 40. The worktop 40 is a part of a cabinet in a kitchen. The spring elements 22 press against the inner sides of the cutout 38.

In this example the circumference of the cutout 38 is marginally bigger than the circumference of the upper part 26 of the cooking hob 24. Thus, the cutout 38 encloses the upper part 26 along its circumferential side. Alternatively, the circumference of the upper part 26 may be marginally bigger than the circumference of the cutout 38, so that the upper part 26 of the cooking hob 24 is additionally supported by the worktop 40.

A frame 42 encloses the circumferential side of the upper part 26 of the cooking hob 24. The frame 42 is directly fixed at the upper part 26. The cooking hob 24 may be equipped with different frames 42, so that the design of the cooking hob 24 may be easily varied. The frame 42 max have optical and/or supporting purposes. Additionally, the design element 16 may have a sealing function.

The fastening element 10 according to the present invention allows a simple and fast assembling of the upper part 26 and the lower part 28 on the one hand and a subsequent installation of the resulting cooking hob 24 within the cutout 38 of the worktop 40 on the other hand. The fastening element 10 according to the present invention has two different functions, namely the connection between the upper part 26 and the lower part 28 and the connection between the cooking hob 24 and the cutout 38. Two inventive fastening elements 10 are sufficient for a robust installing the two-part cooking hob 24 in the cutout 38 of the worktop 40, if the fastening elements 10 are arranged at opposite sides of the cooking hob 24.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 fastening element
12 upper portion of the fastening element
14 lower portion of the fastening element
16 supporting element
18 lug element
20 appendix
22 spring element
24 cooking hob
26 upper part of the cooking hob, glass-ceramic panel
28 lower part of the cooking hob
30 recess
32 sidewall of the lower part
34 slot
36 bottom of the lower part
38 cutout
40 worktop
42 frame

The invention claimed is:

1. A one-piece fastening element (10) for a cooking hob (24), wherein: the fastening element (10) comprises an upper portion (12) being permanently connectable to an upper part (26) of the cooking hob (24), the fastening element (10)

comprises a lower portion (14) being detachably connectable to a lower part (28) of the cooking hob (24), so that the upper part (26) and the lower part (28) form the cooking hob (10), the lower portion (14) of the fastening element (10) comprises at least one lug element (18) engageable with a recess (30) in the lower part (28) of the cooking hob (24), and the lower portion (14) of the fastening element (10) comprises at least one U-shaped leaf spring element (22) for clamping the cooking hob (24) within a cutout (38) enclosing circumferentially said cooking hob (24).

2. The fastening element according to claim 1, characterized in, that the upper portion comprises at least one sheet element extending along a horizontal plane and the lower portion comprises sheet elements extending along a vertical plane in a mounted state of said fastening element at the cooking hob.

3. The fastening element according to claim 1, characterized in, that the lug element is formed at a vertical sheet element and extends along a vertical direction in the mounted state.

4. The fastening element according to claim 2, characterized in, that the vertical sheet (16) with the lug element (18) comprises a buckled appendix (20) acting as a grip in order to release the lug element (18) from the recess (30).

5. The fastening element according to claim 2, characterized in, that at least two sheet elements (16, 22) are displaced in such a way that a sidewall (32) of the lower part (28) is engageable between said sheet elements (16, 22).

6. The fastening element according to claim 5, characterized in, that the sidewall (32) is engageable in such a way that the large-scale sides of said sidewall (32) rest partially at large-scale sides of the sheet element (16, 22).

7. The fastening element according to claim 2, characterized in, that the spring element (22) comprises elastic properties wherein a connectable end of said spring element (22) meets the sheet element (12) forming an edge and a free end of said spring element (22) is capable of moving towards and away from the edge.

8. The fastening element according claim 1, characterized in, that the fastening element (10) is made of a metal sheet.

9. The fastening element according to claim 1, characterized in, that the first portion (12) of the fastening element (10) is glueable at the upper part (26) of the cooking hob (24).

10. The cooking hob according to claim 1, characterized in, that the cooking hob (24) includes at least two one-piece fastening elements (10).

11. A cooking hob comprising at least two one-piece fastening elements arranged or mountable at outer portions of the cooking hob, wherein the fastening element comprises an upper portion being permanently connected or connectable to an upper part of the cooking hob and a lower portion being detachably connected or connectable to a lower part of the cooking hob, so that the upper part and the lower part form the cooking hob, the lower part of the cooking hob comprises at least two recesses in sidewalls, and at least two slots in a bottom of the lower part wherein each of said two slots is associated with a respective one of said two recesses in order to allow a tool to penetrate through each of said two slots in order to release at least one lug element from the respective one of said two recesses, the lower portion of the fastening element comprises the at least one lug element engaged or engageable with the recess, the lower portion of the fastening element comprises at least one spring element at a side wall of the cooking hob in order to clamp the cooking hob within a cutout enclosing circumferentially the cooking hob, and at least two fastening elements are arranged at opposite side walls of the cooking hob.

12. The cooking hob according to claim 11, characterized in, that the upper part (26) of the cooking hob (24) is a glass-ceramic panel and the lower part (28) of the cooking hob (24) is a casing (32, 36) covered by said glass-ceramic panel in a mounted state.

13. The cooking hob according to claim 12, characterized in, that the casing (32, 36) is made of at least one metal sheet.

14. The cooking hob according to claim 11, characterized in, that the slots (34) each have a rectangular-shaped opening bigger than the lug element (18) in order to allow a tool to penetrate through each said slot (34) wherein, the upper part (26) of the cooking hob (24) is easily removed from the lower part (28).

15. The cooking hob according to claim 14, characterized in, that the opening or the slot (34) is arranged in the outermost position of the bottom (36) and under the corresponding recess (30).

16. The cooking hob according to claim 11, characterized in, that the free end of the spring element (22) extends outwardly from the cooking hob (24) and is capable of flexing inwardly toward the cooking hob (24).

* * * * *